United States Patent [19]

Romig, Jr.

[11] 4,398,377

[45] * Aug. 16, 1983

[54] STRUCTURAL MEMBER WITH EQUALIZED INTERNAL TENSION

[76] Inventor: Byron A. Romig, Jr., 3920 Eagle Rock Blvd., Los Angeles, Calif. 90065

[ * ] Notice: The portion of the term of this patent subsequent to Feb. 2, 1999, has been disclaimed.

[21] Appl. No.: 323,409

[22] Filed: Nov. 20, 1981

Related U.S. Application Data

[63] Continuation-in-part of Ser. No. 115,502, Jan. 25, 1980, Pat. No. 4,313,287.

[51] Int. Cl.[3] ..... E04C 3/10

[52] U.S. Cl. ..... 52/223 R; 29/446; 52/230; 403/43; 403/348

[58] Field of Search ..... 52/223 R, 223 C, 230, 52/730, 727, 728, 724, 723, 741; 403/348, 43, 44, 45; 29/446, 452

[56] References Cited

U.S. PATENT DOCUMENTS

| | | | |
|---|---|---|---|
| 240,387 | 4/1881 | Cowdy | 411/187 |
| 485,484 | 11/1892 | Arnold | 403/44 |
| 833,263 | 10/1906 | Tracy . | |
| 1,552,300 | 9/1923 | Hersey . | |
| 2,016,273 | 10/1935 | Atwood | 52/731 |
| 2,303,394 | 12/1942 | Schorer | 52/223 R |
| 2,347,879 | 5/1944 | Branton | 52/731 |
| 2,615,678 | 10/1952 | Stent | 52/223 R |
| 3,104,532 | 9/1963 | Severinsson | 403/348 |
| 3,158,236 | 11/1964 | Caliguiri | 72/264 |
| 3,237,362 | 3/1966 | Fromson | 52/731 |
| 3,238,690 | 3/1966 | Wilkins | 52/731 |
| 3,271,917 | 9/1966 | Rubenstein | 52/724 |
| 3,300,927 | 1/1967 | Bettol | 52/309.13 |
| 3,327,441 | 6/1967 | Kelly | 52/730 |
| 3,405,490 | 10/1968 | Marr | 52/223 |
| 3,413,775 | 12/1968 | Katz | 52/727 |
| 3,698,150 | 10/1972 | Anderson | 52/771 |
| 3,708,380 | 1/1973 | Niebylski | 161/43 |
| 3,858,374 | 1/1975 | Ben-Zri | 52/724 |
| 3,864,049 | 2/1975 | Ono | 52/227 |
| 3,882,650 | 5/1975 | Gugliotta | 52/223 |

*Primary Examiner*—Price C. Faw, Jr.
*Assistant Examiner*—Henry E. Raduazo
*Attorney, Agent, or Firm*—Fulwider, Patton, Rieber, Lee & Utecht

[57] ABSTRACT

A structural member having an elongated body shell, which may be fiberglass, and a pair of caps engaging the ends of the shell. A plurality of bands extend through the shell connecting the caps and pulling them toward each other, thus rigidifying the member and securing the caps. At one end of the member, the bands are secured to the corresponding end cap by a distribution member that engages a pull member. The distribution member can pivot on the pull member to at least partially equalize tension on the bands. A tensioning member engages the pull member so that tension can be applied. At a predetermined tension, a drive piece connected to the tensioning member breaks away. Contact between the interior surface of the shell and the side edges of the bands can cause the shell to resist collapse.

15 Claims, 5 Drawing Figures

STRUCTURAL MEMBER WITH EQUALIZED INTERNAL TENSION

RELATED APPLICATIONS

This is a continuation-in-part of applicant's earlier application Ser. No. 115,502 filed on Jan. 25, 1980, entitled Internally Tensioned Structural Member and Method of Making Same now U.S. Pat. No. 4,313,287.

FIELD OF THE INVENTION

The present invention relates to structural members, and, more particularly, to such members that include an outer shell of fiberglass or a similar material.

BACKGROUND OF THE INVENTION

Structural members such as tower legs and other columns are frequently made of steel or other metal and sometimes of wood. These conventional materials have become increasingly costly, but to date little use has been made of alternative materials, such as fiberglass. Fiberglass has sufficient strength for many applications and has the advantage of being light in weight, which reduces shipping costs and makes the material easier to handle. In addition, the members can be fabricated in a large variety of sizes and configurations, short production runs being feasible. Moreover, the amount of fiberglass incorporated in the member and the resulting load-bearing capacity can be varied considerably without changing external dimensions.

One reason that fiberglass members have not come into common use is that it has proven difficult to attach such members to the surrounding structure. It can be equally difficult to attach any components of the member that are not formed by the fiberglass itself.

A primary objective of the present invention is to provide an improved fiberglass structural member which overcomes the attachment difficulties previously associated with this material. A further objective is to provide such a member of increased strength and rigidity.

SUMMARY OF THE INVENTION

The present invention resides in a structural member that accomplishes the above objectives and in a method for the assembly of such a member. It includes an elongated body shell formed of fibers and a bonding medium, the shell having an open interior extending axially throughout. A pair of end caps are disposed across the ends of the shell and pulled toward each other by bands held in tension. The caps are thus secured to the shell.

Preferably, the bands are filament wound loops. While the body shell can advantageously be formed of fiberglass, it is desirable to use metal for the end caps. Preferably, the end caps carry external fastening means.

In a preferred embodiment, the bands are attached to the end caps by anchors, at least one of the anchors being movable to apply tension to the bands. The movable anchor includes a pull member engaged by a distribution member, the distribution member being pivotably movable to at least partially equalize the tension on the bands. The pull member and the distribution interlock to prevent relative rotation. The distribution member can define a socket, in the form of part of a sphere, in which the pull member is received.

It is advantageous to arrange interior surfaces of the shell so that they contact the side edges of the bands. Since the bands are rigidified by the tension, they resist collapse of the shell. Preferably, the shell is a multisided box-like enclosure.

The tensioning member, which has a head, received by a recess in the corresponding end cap, can be rotated by a drive member attached in such a manner that it breaks away once a predetermined tension has been applied. In one embodiment, serrations on the head of the tensioning member can engage the end cap to prevent counter-rotation that would result in a loss of tension.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figures 1, 2, 3, 4, 5:
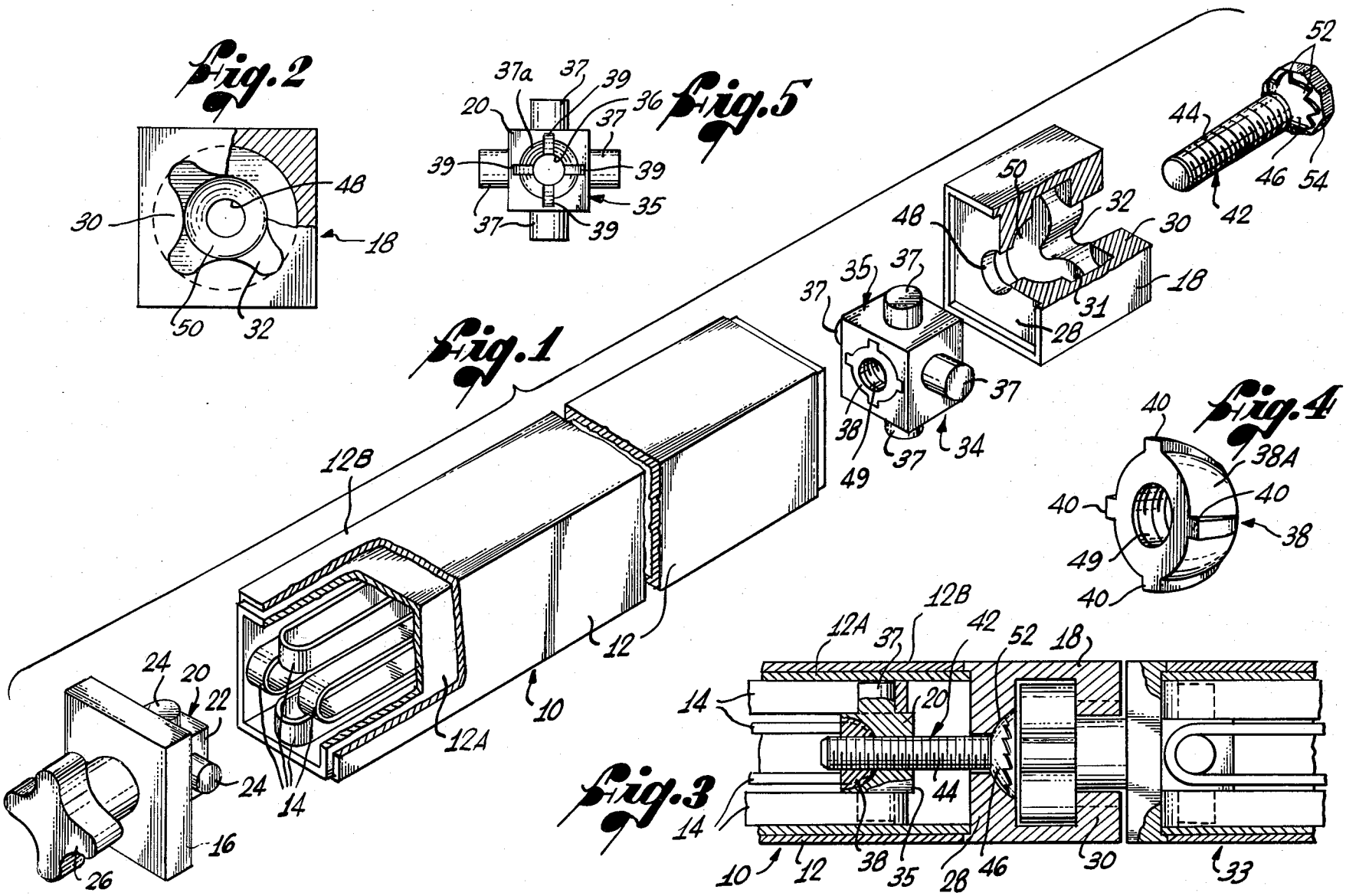
FIG. 1 is an exploded, three-dimensional view of a structural member constructed in accordance with the invention, part of the shell being broken away to expose the bands and part of one end cap being broken away to expose its interior.
FIG. 2 is an end view of an end cap taken as indicated by the line 2—2 in FIG. 1, a portion of the end cap being broken away to expose its interior.
FIG. 3 is a fragmentary cross-sectional, side view of two attached structural members each similar to the member shown in FIG. 1.
FIG. 4 is a perspective view of the pull member of the structural member of FIG. 1.
FIG. 5 is a front end view of the distribution member of the structural member of FIG. 1.

A column 10, shown in FIG. 1 of the accompanying drawings, is suitable for use as, for example, a tower leg. It is exemplary of the many structural members that can be constructed in accordance with the present invention.

The column 10 includes a four-sided, box-like, fiberglass body shell 12. The shell 12 is formed by an inner layer 12A that is filament wound parallel to the longitudinal axis of the column 10 and an outer layer 12B that is filament wound perpendicular to the longitudinal axis. This technique for arranging the fibers within the resinous bonding material provides a shell 12 of superior strength. An alternative method of forming the shell 12 would utilize pulltrusion, which results in a structure having a very high resistance to compressive forces.

Within the shell 12 are four fiberglass bands 14 each of which is filament wound as a loop. Each of the bands 14 extends longitudinally throughout the open interior of the shell 12 and is oriented so that one of its two loop-shaped endless side edges is contiguous with the flat interior surface of a corresponding side of the shell 12. While this band construction is preferred, other types of bands, such as woven steel cables, could be used.

Engaging and covering the open ends of the shell 23 are steel end caps 16 and 18. The first end cap 16 is basically a steel plate that interlocks with one end of the shell 12. The inner layer 12A of the shell 12 projects slightly beyond the outer layer 12B and fits into the end cap 16 to interlock and prevent transverse relative movement and to prevent rotation (note the right-hand side of FIG. 3).

On the inside of the first end cap 16 is an integrally formed anchor 20 that includes a rectangular support 22 projecting a short distance along the longitudinal axis of the shell 12 and four cylindrical lugs 24 that project radially from the support 22. Each of the lugs 24 extends perpendicularly to one side of the shell 12 and is circled by an end of one of the bands 14, as shown in FIG. 3. On the outside of the first end cap 16 is a cross-shaped external fastener 26, the use of which will be explained below.

At the opposite end of the body shell 12, the second end cap 18 interlocks with the shell in the same manner as the first end cap 16. However, the second end cap 18 is of a different construction having two parallel plates 28 and 30 that define a cavity 31 between them. The inner plate 28 rests against the end of the shell 12.

The outer plate 30 is provided with a cross-shaped opening 32 that serves as an external fastener. This opening 32 is of the same configuration as the male fastener 26 at the opposite end of the column 10, but is rotationally displaced 45 degrees with respect to the male fastener. Accordingly, two similar columns 10 and 33 can be interlocked by inserting the male fastener 26 of one column 33 in the opening 32 of the other column 10 and then rotating two columns relative to each other until the flat sides are aligned (see FIG. 3). Of course, a wide variety of known fasteners, some suitable for joining more than two structural members at a common junction, can be substituted for the fasteners 26 and 32 described here.

Just inside the second end cap 18 is a movable anchor 34 that includes a large four-sided distribution member 35 (shown separately in FIG. 5) having an opening 36 aligned with the longitudinal axis of the column 10. Four radially projecting cylindrical lugs 37 extend from the distribution member 35 to engage the ends of the bands 14. Thus, the bands 14 extend between the first anchor 20 and the distribution member 35 of the second anchor 34.

A socket 37A defined by the distribution member 35 defines part of a sphere and faces the first anchor 20. It receives a pull member 38, the opposing surface 38A of which forms part of the surface of a slightly smaller sphere. The surface of the exemplary socket 37A has four grooves 39 therein displaced from each other by 90 degrees and extending away from the first anchor 20 toward the deepest part of the socket and the opening 36. The pull member 38 has four protruding ridge-like ears 40 on its spherical surface 38A that are received by the grooves 39. In this way the pull member 38 and the distribution member 35 are contoured to interlock and prevent relative rotation of these two members.

To retain the pull member 38 against axial movement toward the first anchor 20 is a function of a tensioning member 42 that includes a threaded shank 44 and an enlarged convex head 46 at its outer end. The shank 44, which serves as a bolt, extends through a central aperture 48 in the inner plate 28 through the opening 38 in the distribution member 35 and is engaged by a central threaded opening 49 in the pull member 38 that serves as a nut. Thus, the pull member 38 and the distribution member 35 are articulately engaged. The pull member 38 is held firmly against the distribution member 35 but is pivotable through a small angle since it does not fit tightly in the distribution member 35.

A concave, counter-sunk recess 50 in the outer surface of the inner plate 28 surrounds the aperture 48 and receives the head 46 of the tensioning member 42. Serrations 52 on the head 46 engage the surface of the recess 50 to prevent undesired rotation of the tensioning member 42.

To assemble the column 10, the bands 14 are placed within the body shell 12 so that they protrude from the open end where the second end cap 18 is to be positioned. The protruding band ends can then be looped over the lugs 37 of the distribution member 35. The free ends of the bands 14 are then withdrawn from the opposite end of the shell 12 so that the movable second anchor 34 is pulled into the shell. It is then possible to connect the bands 14 to the lugs 24 of the first anchor 20.

The second end cap 18 is then interlocked with the opposite end of the body shell 12 to close the column 10. At this point, the bands 14 are only loosely held. Next, the tensioning member 42 is inserted through the aperture 48 of the second end cap 18 and the opening 36 in the distribution member 35 so that the shank 42 engages the threads of the pull member 38. It may be necessary to temporarily retain the pull member 38 within the distribution member 35 using tape or adhesive.

At this stage in the assembly of the column 10, the tensioning member 42 carries a break-away drive piece 54 that, along with the head 46 to which it is attached, passes through the center of the cross-shaped opening 32 of the second end cap 18. The drive piece 54 is engaged by a suitable tool to rotate the tensioning member 42. Rotation in the proper direction causes the distribution member 35 to be pulled toward the second end cap 18. In this manner, the bands 14 are stretched between the two anchors 20 and 34. After a predetermined tension has been applied to the bands 14, the drive piece 54 breaks off and can be extracted from the second end piece 18 through the cross-shaped opening 32. The serrations 52 do not interfere with rotation of the tensioning member 42 in the direction that increases the tension on the bands 14. They do, however, bite into the surface of the recess 50 to prevent tension reducing counter-rotation.

It should be noted that the tensioning member 42 will assume a centered axial position because of the tension on the bands 14. The position of the pull member 35 is thus rigidly determined because of its threaded engagement with the tensioning member 42. The distribution member 38 is, however, free to move pivotably through a small angle to equalize the tension on opposite bands 14. This tension equalization will avoid excessive stressing of any one side of the shell 12. Because the tension on opposite bands 14 will be the same, any tendency of the shell 12 to deform under a bending movement attributable to the bands 14 will be greatly reduced or eliminated.

The metal end caps 16 and 18 are firmly and permanently secured to the body shell 12 by the tension of the bands 14. It is not necessary to use glue or other mechanical fasteners that would necessarily depend on the strength and integrity of a relatively small portion of the fiberglass shell 12 at the point of attachment. In addition, the bands 14 strengthen and rigidify the column 10 to inhibit any type of twisting or bowing since at least one of the bands 14, which are in tension, would resist the elongation that would necessarily accompany any such deflection. Another function of the bands 14 is to strengthen the sidewalls of the shell 12 which are in contact with the endless loop-shaped side edges of the bands, thereby preventing the shell from collapsing.

The parameters of the column 10 can be carried with relative ease during the manufacturing process by changing the thickness of the fiberglass or varying the materials used without changing external dimensions significantly. The ridigity of the column 10 can be altered by changing the tension on the bands 14.

While a particular form of the invention has been illustrated and described, it will be apparent that various modifications can be made without departing from the spirit and scope of the invention.

I claim:

1. A structural member comprising:

an elongated body shell formed by fibers and a bonding medium, said body shell having an open interior extending axially throughout between two ends;

a pair of end pieces disposed at said ends;

a plurality of elongated bands axially disposed within said shell;

anchor means for securing said bands to at least one of said end caps including a pull member and a distribution member pivotably movable relative to said pull member to at least partially equalize the tension on said bands.

2. The structural member of claim 1 wherein said anchor means further includes tensioning means for adjustably positioning said anchor means relative to said end cap.

3. The structural member of claim 1 wherein said distribution member defines a socket therein in which said pull member is received, said socket being larger than said pull member, thereby permitting said pull member to move within said socket.

4. The structural member of claim 3 wherein said socket defines part of the suface of a sphere and said pull member defines part of the surface of a smaller sphere.

5. The structural member of claim 4 wherein said anchor means further includes tensioning means for adjustably positioning said pull member relative to said last mentioned end cap.

6. The structural member of claim 5 wherein said tensioning means extends through said distribution member into said engagement with said pull member.

7. The structural member of claim 6 wherein said tensioning means threadedly engages said pull member, whereby said tensioning means forms a bolt and said pull member forms a nut.

8. The structural member of claim 1, 4, 5, 6 or 7 wherein said pull member and said distribution member are contoured to interlock with each other to prevent relative rotation therebetween.

9. The structural member of claim 5 wherein said tensioning means further includes a plurality of serrations engaging said one end cap to prevent undesired rotation of said tensioning member.

10. The structural member of claim 1 wherein each of said bands forms a loop.

11. The structural member of claim 1 wherein said body shell has a least one interior surface that contacts said bands substantially throughout the length thereof.

12. The structural member of claim 1 further comprising exterior fastening means for fastening said end caps to other members.

13. The structural member of claim 1 wherein said bands form loops and said distribution member has lugs thereon engaged by said bands.

14. The structural member of claim 13 wherein there are four of said bands.

15. A structural member comprising:

an elongated, four-sided, box-like fiberglass body shell having two opposite ends;

a pair of metal end caps engaging said ends;

four loop-shaped filament wound bands extending longitudinally through said body shell, each of said bands having two parallel, endless side edges, said body shell having four flat interior surfaces each in contact with one of said side edges;

anchor means for securing said bands to said caps, said anchor means including a pull member at one end of said body shell having a threaded opening therein and a distribution member defining a socket forming part of the surface of a sphere in which said pull member is received, said pull member defining part of the surface of a smaller sphere and thereby being pivotably movable in said socket, and said distribution member having lugs thereon engaged by said bands; and tensioning means for adjustably positioning said pull member comprising a threaded shank engaged by said threaded opening in said pull member, a head attached to said shank, a plurality of serrations on said head, and drive means attached to said head for rotating said tensioning means and for breaking away from said head when a predetermined tension has been applied.

* * * * *